United States Patent [19]

Benoit et al.

[11] 4,017,760

[45] Apr. 12, 1977

[54] PARASITIC OSCILLATION SUPPRESSOR FOR ELECTRONIC TUBES

[75] Inventors: Michel Benoit; Pierre Gerlach, both of Paris, France

[73] Assignee: Thomson-CSF, Paris, France

[22] Filed: Jan. 9, 1976

[21] Appl. No.: 647,768

[30] Foreign Application Priority Data

Jan. 14, 1975 France ..... 75.00991

[52] U.S. Cl. ..... 315/39; 333/81 R; 333/98 M

[51] Int. Cl.[2] ..... H01J 7/46; H01J 19/80

[58] Field of Search ..... 315/39; 333/98 M, 81 R, 333/83 A

[56] References Cited

UNITED STATES PATENTS

| | | | |
|---|---|---|---|
| 2,684,469 | 7/1954 | Sensiper | 333/98 M |
| 2,853,646 | 9/1958 | Geisler, Jr. | 315/39 X |
| 2,877,434 | 3/1959 | Farr et al. | 333/98 M |
| 3,354,346 | 11/1967 | Lavik | 315/3.5 |
| 3,496,497 | 2/1970 | Conning | 333/98 M X |
| 3,634,790 | 1/1972 | Turteltaub | 333/98 M |

*Primary Examiner*—Saxfield Chatmon, Jr.
*Attorney, Agent, or Firm*—Roland Plottel

[57] ABSTRACT

A device for suppressing parasitic oscillations in electronic power tubes of coaxial structure. It is constituted by an electrically conductive component of cylindrical form with a flange, containing an odd number of resonant circuits of the RLC type, with distributed constants. Each circuit comprising at least one inductance coupled to at least one capacitor. The latter are respectively constituted by an opening and a slot in said component. The circuits are tuned to the range of frequencies of the parasitic oscillations.

16 Claims, 6 Drawing Figures

PARASITIC OSCILLATION SUPPRESSOR FOR ELECTRONIC TUBES

The present invention relates to the field of electronic power tubes and more particularly relates to a device for suppressing parasitic oscillations which can develop in tubes that have a coaxial structure.

These tubes utilise cylindrical electrodes arranged coaxially. Sometimes, under certain operating conditions the tubes, develop parasitic oscillations since two neighbouring electrodes constitute a section of a coaxial waveguide. This disturbing phenomenon which is intrinsically associated with the geometry of the structures, occurs primarily in the TE11 or TE21 microwave modes. It disturbs the operation of the tube due to the spontaneous generation of unwanted oscillations and especially to the over-voltage and excessive currents which can be created, and which can in turn give rise to burning out and breakdown.

Various systems for damping oscillations are known, in particular in the context of microwave cavities, but their inclusion in an electronic tube is not normally possible because of the additional stress which is introduced. These systems must be capable of operating in a hot environment and not disturbing either the quality of the vacuum or the geometry of the tube since the latter is dictated by other electronic parameters. Also the systems in question must not introduce any losses within the operating frequency range of the tube.

According to the present invention, there is provided a device for suppressing parasitic oscillations in an electronic tube having a coaxial structure, comprising a component made of an electrically conductive material and substantially in the form of a cylinder with a flange, said component carrying a plurality of resonance circuits each of RLC type and incorporating at least one inductance constituted by an opening in said component coupled to at least one capacitor constituted by a slot in said component, said resonant circuits being tuned to the frequency range of said parasitic oscillations, the surface of said flange and the angle said flange makes with the surface of said cylinder being such that the impedance variation produced in the tube by said component is minimised, said component being arranged in the electronic tube in such a fashion that said resonant circuits are coupled to said parasitic oscillations.

Figure 1:
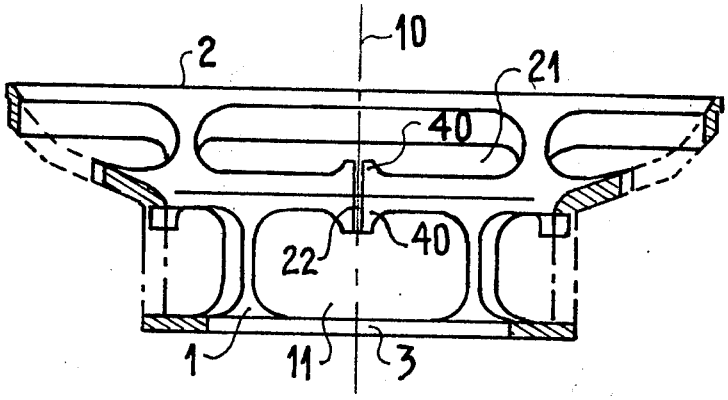
Figure 2:
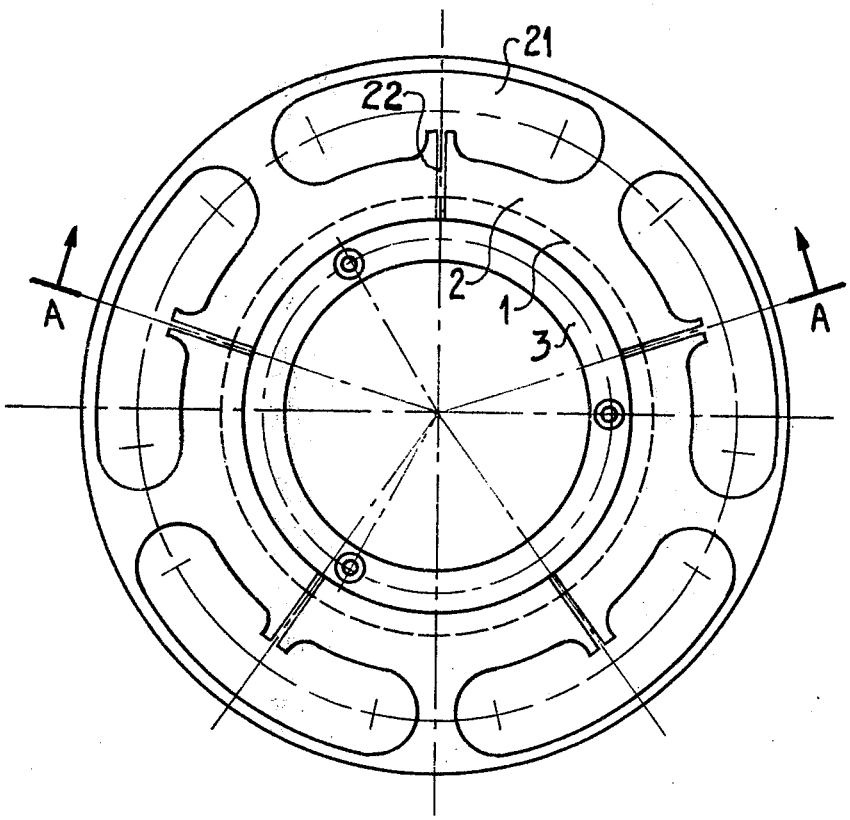
Figure 3:
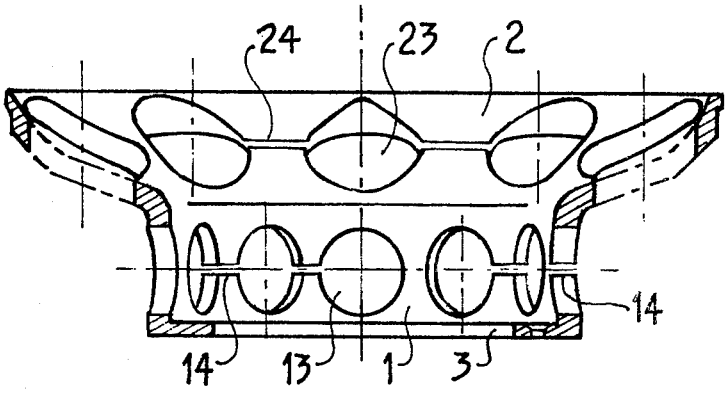
Figure 4:
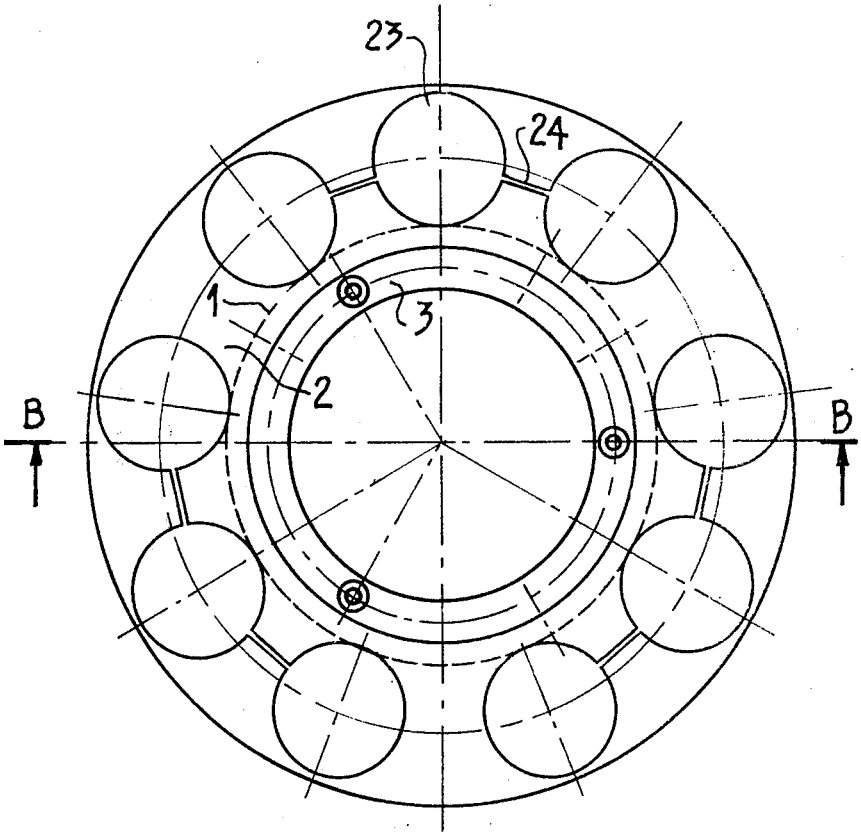
Figure 5:
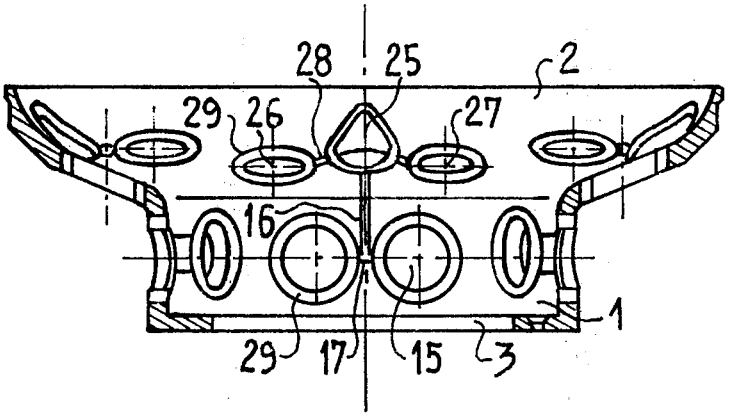
Figure 6:
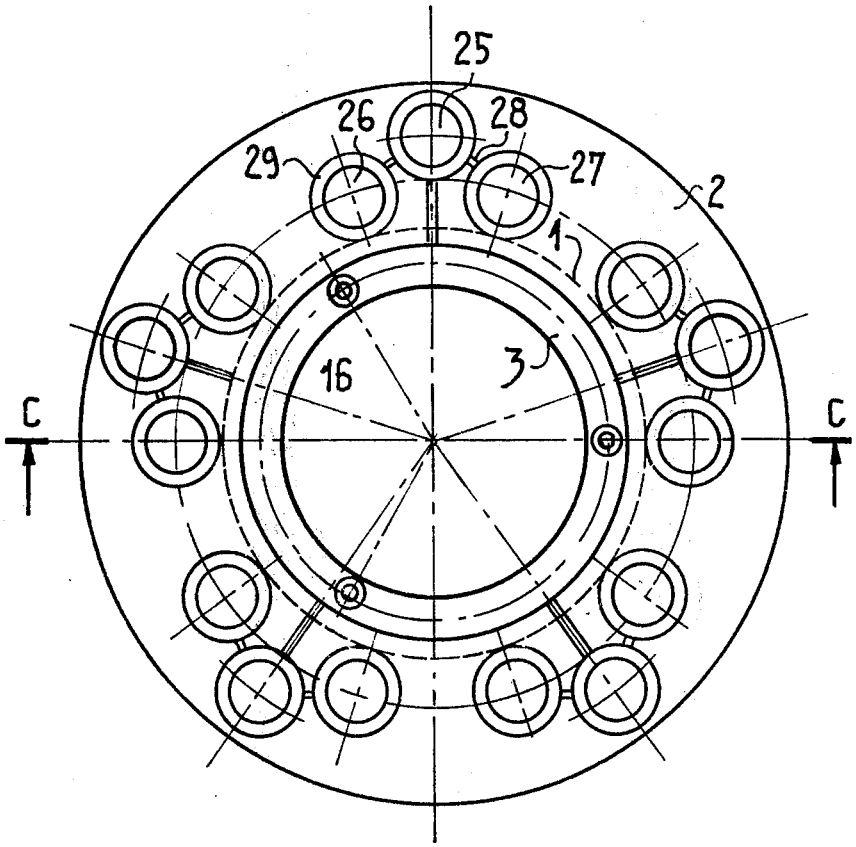

For a better understanding of the invention and to show how it may be carried into effect, reference will be made to the following description and the attached figures in which:

FIGS. 1 and 2 respectively illustrate a sectional and a plan view of a first embodiment of the device in accordance with the invention;

FIGS. 3 and 4 illustrate respectively a sectional and plan view of a second embodiment of the device in accordance with the invention;

FIGS. 5 and 6 respectively illustrate a sectional and plan view of a variant embodiment of the device in accordance with the invention, further comprising lumped loads.

In these various figures, similar references relates to similar elements.

FIG. 2 illustrates a plan view and FIG. 1 a sectional view in accordance with the line AA, of an electrically conductive component primarily comprising a cylindrical portion 1 terminated in a flange 2. The flange 2 makes an angle with the axis 10 of the cylinder 1, which may range between 0° and 90° but preferably has a fairly high value and is determined by considerations which will be discussed later. The cylindrical portion 1 terminates at its other end, the one remote from the flange 2, in a fixing element 3 which is used to attach the assembly 1 and 2 to the remainder of the tube; the fixing element 3 may for example be a ring whose plane is perpendicular to the axis 10. The component shown in FIGS. 1 and 2 will preferably be produced by machining it on one piece from metal and graphite for example.

The cylinder 1 and the flange 2 contain openings, 11 and 21 respectively, located substantially one above the other, and slots such as 22 linking an opening 11 to the opening 21 located above it. These elements respectively constitute the inductances and capacitors of resonant circuits of RLC type with distributed constants; the resistors being constituted by the material itself. More precisely, an inductive opening 21 and the capacitive slot 22 corresponding to it, constitute a resonant circuit carried by the flange 2 which is coupled, through the medium of the slot 22, to the resonant circuit carried by the cylinder 1 and constituted by the said same slot 22 and the corresponding opening 11.

The inductive openings 11, 21 and the capacitive slots 22 are dimensioned in such a fashion that resonance occurs at the frequency of the parasitic oscillations, with a sufficient pass-band. As those skilled in the art will appreciate, the determination of the frequency, of the pass-band and consequently of the Q factor, and the choice of the material, that is to say its resistivity $\rho$ and its magnetic permeability $\mu$, make it possible to determine the values of the inductances L and capacitances C and consequently the dimensions of the corresponding openings and slots. Calculations generally make it possible to produce inductive openings of substantially circular shape. The shapes shown in FIGS. 1 and 2 have been obtained experimentally and we are dealing here with elongated openings with a width of around one quarter of its length, exhibiting a protuberance 40 at the level of the capacitive slot 22.

In this fashion, two distinct groups of resonant circuits are obtained, whose function is to give the device maximum efficiency:

In other words, the magnetic lines of force corresponding to the TE parasitic modes are curvilinear and converge towards the axis 10 of the tube which is also the axis of the cylinder 1. The first group of circuits, carried by the cylinder 1, has maximum efficiency vis-a-vis the lines of force when they converge radially towards the axis; the second group of circuits, carried by the flange 2, has maximum efficiency vis-a-vis the same lines of force, at those of their parts which are parallel to the cylinder axis. With this kind of arrangement, thus, there are always two coupled resonant circuits for one and the same line of force, and this in particular means, as those skilled in the art will appreciate, that the pass-band of the device is enlarged.

In addition, in order to obtain suitable coupling between the resonant circuits and the parasitic modes of oscillation, preferentially an odd number of inductive openings will be provided in each group of circuits, for the following reason: on the one hand, the parasitic modes of oscillation most frequently occuring in coaxial electronic tubes, namely the modes TE11 and TE12, correspond to even distributions of lines of force; on the other hand coupling between the component and the resonant circuit of this tube is maximum when the magnetic flux passing through the inductive openings is at a maximum.

In view of the fact that the system is rotationally symetrical, it is therefore preferable to provide an odd number of openings in order to prevent the flux maxima from occuring in the openings, i.e. a condition yielding minimum coupling.

In the first embodiment, there are five inductive openings corresponding to optimising of the various parameters, in particular the essential parameter of maximum flux across the inductive openings, with the dimensions of these openings being fixed in accordance with the frequency of the parasitic oscillations.

Thus, a device has been obtained which is constituted by an assembly of resonant circuits created and arranged in such a fashion as to be tuned to the range of frequencies of the parasitic oscillations requiring damping, and to be coupled to the circuits in which said oscillations are liable to develop. If these oscillations appear at all, they are absorbed at least partially by the device and dissipated in the form of heat, and with an efficiency which is the greater the closer their frequency comes to the resonance frequency of said circuits. If the absorption thus achieved is adequate, the conditions for the maintenance of the parasitic oscillations cease to be satisfied and these oscillations are accordingly damped.

The material of which the component shown in FIGS. 1 and 2 is made, is chosen as a function of its parameters resistivity ($\rho$) and magnetic permeability ($\mu$). In other words, in the range of frequencies which are to be eliminated, it is necessary that the distributed resistance (R) of each circuit should be sufficiently high. For a frequency (f) and a given geometry, this resistance depends upon the resistivity ($\rho$) of the material and upon its equivalent thickness at the high frequency in question (or depth of penetration of the electric current at this frequency); the thickness $\gamma$ is given by $$\delta = K. \sqrt{\frac{\rho}{\mu \cdot f}}$$

where K is a constant associated with the geometry of the conductors and the units chosen.

However, the dissipation of the energy converted into heat is normally a difficult problem so that the material is chosen in accordance with the selected operating frequencies, in order to avoid excessive dissipation: e.g. when dealing with tubes designed for shortwave and very shortwave applications, a material is chosen having a low permeability ($\mu$) and a relatively high resistivity ($\rho$), i.e. a material such as graphite; if the tube is intended for medium or longwave applications, then preferably steel will be used (high $\mu$; medium $\rho$), this being easier to deal with and less expensive.

Finally, as far as the positioning of the device in the electronic tube is concerned, various solutions are open, among which the following can be listed:

that region of the tube located between the anode and the tube base;

the central part of the anode itself in the case of a tube having two superimposed cathodes and provided at this location with a neutral, non-bombarded zone;

the tube region located opposite the base, between the anode and the last grid.

In all instances, the angle of the flange 2 in relation to the axis 10, and also its curvature, are chosen so that the presence of the component gives rise to no impedance breakdown of the kind which could cause reflection of the parasitic waves requiring damping, at the component. Thus, in the case for example where one has opted for the third of the possible locations referred to earlier, the flange 2 is not a rightangles to the surface of the cylinder 1 (its angle vis-a-vis the projection thereof being around 60°), and is slightly concave towards the tube interior so that it remains parallel to the end of the grid behind which is has been arranged. It is this last latter embodiment which has been shown in the figure.

FIG. 4 illustrates a plan view and FIG. 3 a sectional view on the line BB, of a second embodiment of the device in accordance with the invention.

It is constituted, as in the preceding embodiment, by an electrically conductive component with a cylindrical portion 1 terminated by a flange 2 at one end and by a fixing element 3 at the other.

The cylinder 1 is equipped with inductive openings 13 of circular shape, connected together in groups through the medium of capacitive slots 14. In the example shown in FIGS. 3 and 4, the cylinder 1 comprises nine openings 13 connected with one another in groups of three by two slots 14.

The flange 2 is likewise equipped with inductive openings 23 of circular shape, preferably arranged in the same manner as those in the cylinder 1, that is to say numbering nine and grouped in threes by capacitive slots 24.

The determination of the various parameters, namely dimensions, number and arrangement of the inductive openings and the shape of the flange 2 is performed as before. Again, the operation of the device is identical.

The significance of this embodiment is that the pass-band of the device is widened due to the capacitive coupling which is effected in each group, between three inductance.

FIG. 6 illustrates a plan view and FIG. 5 a sectional view on the line CC of a further embodiment of the device in accordance with the invention, in which lumped loads have been added.

The device is still constituted by a conductive component comprising a cylinder 1, a flange 2 and a fixing element 3.

In this embodiment, the flange 2 also has with groups of inductive openings, but five groups of three openings (25, 26 and 27) which are not arranged on the same radius; and the central opening (25) is a little further out than the two lateral openings (26 and 27). The three openings in each group are linked by two capacitive slots 28.

The cylinder 1 likewise comprises five groups of inductive openings (15) but each of them has only two openings coupled through the medium of a capacitive slot (17).

The groups of openings 15 are each capacitively coupled to a group of openings 25-26-27 in the flange 2, for example by a capacitive slot 16 linking the slot 17 with the opening 25. Thus, in this embodiment, again a widening of the pass-band is achieved due to the capacitive coupling of the inductances. The inductive openings in the cylinder 1 and the flange 2 are internally covered in each case by a cylindrical element 29 made of a material in which power dissipation is low at the operating frequencies of the tube, and high at the frequencies of parasitic oscillations. A suitable material may for example be a ferrite or a special microwave material.

This latter embodiment can be used where absorption by means of devices of the kind shown in FIGS. 1 to 4, would be insufficient, in particular as far as frequencies of the parasitic oscillations are concerned. In other words, the cylinders 29 located at positions where a peak induced current is flowing, that is to say around the inductive openings, constitute lumped loads in which absorption is substantially higher than that which is achieved by means of the devices described earmier. Moreover, the material of which the device is made need not necessarily contribute to the absorption of parasitic oscillations and can therefore be made of a low-loss material such as for example copper.

Of course, the invention is not limited to the embodiment described and shown which was given solely by way of examples.

What is claimed is:

1. A device for suppressing parasitic oscillations in an electronic tube having a coaxial structure, comprising a component made of a material which is electrically conductive in the frequency range of said parasitic oscillations and substantially in the form of a cylinder with a flange, said component carrying a plurality of resonance circuits each of RLC type and incorporating at least one inductance constituted by an opening in said component coupled to at least one capacitor constituted by a slot in said component, said resonant circuits being tuned to the frequency range of said parasitic oscillations, the surface of said flange and the angle said flange makes with the surface of said cylinder being such that the impedance variation produced in the tube by said component is minimised.

2. A device as claimed in claim 1, wherein said resonant circuits are carried in equal numbers by said flange and said cylinder.

3. A device as claimed in claim 2, wherein said resonant circuits are provided in odd numbers in said flange and cylinder.

4. A device as claimed in claim 1, wherein said flange makes an angle of between $\pi/4$ and $\pi/2$ in relation to the cylinder axis.

5. A device as claimed in claim 1, wherein the surface of said flange is concave towards the axis of said cylinder.

6. A device as claimed in claim 1, wherein each of said openings in said flange is coupled to one of the openings in said cylinder through one of said slots.

7. A device as claimed in claim 6, wherein said openings are of elongated shape, each of the openings in said flange being centered on the same radial plane as one of the openings in said cylinder, the slot coupling them having said radial plane as its plane of symmetry.

8. A device as claimed in claim 1, wherein each of said resonant circuits comprises three substantially circular openings, coupled together by two of said slots.

9. A device as claimed in claim 8, wherein said openings are substantially at the same distance from the axis of the cylinder.

10. A device as claimed in claim 1, wherein those of said resonant circuits which are carried by said flange each comprise three substantially circular openings, coupled together by two of said slots; and those of said resonant circuits which are carried by said cylinder each comprise two substantially circular openings, coupled together by a third of said slots, each of the resonant circuits carried by said flange being coupled to a resonant circuit carried by said cylinder, through the medium of a fourth of said slots.

11. A device as claimed in claim 10, wherein said fourth slot joins a medium opening of said flange with said third slot.

12. A device as claimed in claim 1, wherein said resonant circuits further comprise lumped loads.

13. A device as claimed in claim 10, further comprising lumped loads which are constituted by cylindrical components internally covering said openings.

14. A device as claimed in claim 13, wherein said cylindrical components are made of a ferrite material.

15. A device as claimed in claim 1 wherein said component is made of metal.

16. A device as claimed in claim 1, wherein said component is made of graphite.

* * * * *